US007392790B2

(12) United States Patent
Shafer et al.

(10) Patent No.: US 7,392,790 B2
(45) Date of Patent: Jul. 1, 2008

(54) SYSTEM AND METHOD FOR RESOLVING CROSSED ELECTRICAL LEADS

(75) Inventors: Scott Shafer, Morton, IL (US); Daniel Puckett, Peoria, IL (US); Jack Merchant, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 125 days.

(21) Appl. No.: 11/337,248

(22) Filed: Jan. 20, 2006

(65) Prior Publication Data

US 2007/0169750 A1 Jul. 26, 2007

(51) Int. Cl.
*F02M 57/02* (2006.01)
*F02B 17/00* (2006.01)

(52) U.S. Cl. ..... 123/446; 123/198 D

(58) Field of Classification Search ..... 123/446, 123/447, 478, 481, 494, 495, 479
See application file for complete search history.

(56) References Cited

U.S. PATENT DOCUMENTS 3,728,616 A * 4/1973 Cheek et al. ..... 324/538
3,986,106 A * 10/1976 Shuck et al. ..... 324/540
4,227,146 A * 10/1980 Hodge ..... 324/542
4,453,403 A 6/1984 Bussey et al.
4,616,617 A * 10/1986 Geiger et al. ..... 123/436
4,651,084 A * 3/1987 Welsh et al. ..... 324/523
4,714,998 A 12/1987 Bussey et al.
4,834,205 A 5/1989 Mizuno et al.
5,186,144 A * 2/1993 Fukui ..... 123/406.58
5,210,476 A 5/1993 Kazato
5,257,287 A 10/1993 Blumenthal et al.
5,347,225 A * 9/1994 Graham ..... 324/523
5,613,473 A 3/1997 Angermaier
5,633,458 A 5/1997 Pauli et al.
5,970,784 A * 10/1999 Genin ..... 73/117.3
6,253,145 B1 * 6/2001 Garrard et al. ..... 701/105
6,323,656 B2 11/2001 Shoemaker
6,347,517 B1 2/2002 Sereni (Continued)

FOREIGN PATENT DOCUMENTS

DE 199 55 617 A1 6/2001

(Continued)

OTHER PUBLICATIONS

Office Action from U.S. Appl. No. 11/440,755, mailed Oct. 12, 2007, (7 pages).

(Continued)

*Primary Examiner*—Thomas Moulis
(74) *Attorney, Agent, or Firm*—Finnegan, Henderson, Farabow, Garrett & Dunner

(57) ABSTRACT

A control system for controlling a device, the device having at least two functional elements, each functional element being controlled by a control signal, is disclosed in the present disclosure. The control system may include detecting means operatively connected to the device and configured to monitor the operation of the device, and to generate a signal indicative of an operating condition of the device. The control system may also include a control module operatively connected to the at least two functional elements and the detecting means, and configured to switch the two control signals applied to the respective functional elements in response to the signal generated by the detecting means.

23 Claims, 4 Drawing Sheets

U.S. PATENT DOCUMENTS

| | | | | |
|---|---|---|---|---|
| 6,367,316 | B1 | 4/2002 | Eckerle et al. | |
| 6,446,610 | B1 | 9/2002 | Mazet | |
| 6,457,465 | B2 * | 10/2002 | Lee | 123/643 |
| 6,471,540 | B1 * | 10/2002 | Fernandez | 439/490 |
| 6,484,573 | B2 | 11/2002 | Bundock et al. | |
| 6,484,691 | B1 * | 11/2002 | Schuster et al. | 123/305 |
| 6,605,946 | B1 * | 8/2003 | Yokoyama | 324/429 |
| 6,830,033 | B2 * | 12/2004 | Boerkel | 123/406.47 |
| 6,932,057 | B2 * | 8/2005 | Sawada et al. | 123/406.47 |
| 6,988,031 | B2 * | 1/2006 | McDonald et al. | 701/112 |
| 6,990,958 | B2 | 1/2006 | Asano et al. | |
| 7,066,149 | B1 | 6/2006 | Date et al. | |
| RE39,212 | E * | 8/2006 | Yokoyama | 324/429 |
| 7,143,641 | B2 | 12/2006 | Palazzolo et al. | |
| 2004/0154594 | A1 | 8/2004 | Miyashita | |
| 2005/0030934 | A1 | 2/2005 | Takahira et al. | |
| 2007/0070102 | A1 | 3/2007 | Takata | |
| 2007/0169756 | A1 | 7/2007 | Potter et al. | |

FOREIGN PATENT DOCUMENTS

| | | | |
|---|---|---|---|
| DE | 19955617 | A1 | 6/2001 |
| EP | 0 501 459 | A2 | 9/1992 |
| EP | 0 684 375 | A1 | 11/1995 |
| EP | 1450029 | A1 | 8/2004 |
| FR | 2 812 345 | A1 | 2/2002 |

OTHER PUBLICATIONS

PCT International Search Report and Written Opinion, PCT/US2007/000530, mailed Jun. 15, 2007 (10 pages).

* cited by examiner

SYSTEM AND METHOD FOR RESOLVING CROSSED ELECTRICAL LEADS

TECHNICAL FIELD

The present disclosure is directed to a system and method for resolving crossed electrical leads, and more particularly, to a control system and method for resolving crossed electrical leads on high pressure fuel pumps of an engine.

BACKGROUND

Internal combustion engines for vehicles or work machines typically employ a fuel system that includes a fuel tank, a feed or priming pump, a high pressure pump, a high pressure common fuel rail, and a plurality of fuel injectors. The high pressure pump includes an inlet fluidly connected to the priming pump and fuel tank via a low pressure supply line, and an outlet fluidly connected to an inlet of the high pressure common fuel rail via a high pressure supply line. The common rail includes a plurality of outlets that are fluidly connected to fuel injectors via a plurality of high pressure supply lines. Fuel is drawn from the fuel tank by the feed pump and pumped toward the high pressure pump. The high pressure pump in turn pumps the fuel to the common fuel rail. Fuel is supplied to the fuel injectors from the high pressure fuel rail. In the case of a compression ignition engine, actuation of a fuel injector causes high pressure fuel to flow from the common fuel rail directly into the combustion chamber of the engine. This injected fuel is then mixed with air in the combustion chamber and combusted by the heat of compression during the compression stroke of the engine.

It is typical to use solenoid actuators at the inlet and/or outlet of the high pressure pumps to control the opening and closing of the inlet and/or outlet valves, and thereby control the fuel volume passing through the inlet and/or outlet valves to control the supply of high pressure fuel to the high pressure rail. For example, U.S. Pat. No. 6,446,610 to Mazet discloses a system for controlling the pressure in a high pressure common fuel rail, which includes a high pressure pump having a solenoid actuated valve at the inlet of the high pressure pump for controlling the volume of the fuel that passes through the pump inlet and into the pumping chamber. The opening and closing of the inlet valve is controlled to supply the pump chamber with a volume of fuel equal to the sum of the fuel mass to be injected into the combustion chambers of the engine. The delivered fuel volume at least partially compensates for a pressure difference between the measured fuel pressure with the common fuel rail and a target pressure.

In order for the high pressure pump to function properly, the current driving the solenoid actuator of the inlet valve of the high pressure pump must be applied in the correct sequence or phase. However, in industry, electrical leads used for supplying the driving current to the solenoid actuator may be mistakenly connected to the wrong actuator, and thus the current may be applied to an actuator in a reversed phase, which in turn, results in a high pressure pump having actuators that do not function properly. For example, if the driving current is applied to an actuator to open the outlet of the high pressure pump during a return stroke of the high pressure pump plunger, there will be no high pressure pumped out by the high pressure pump. Conventionally, this situation is detected and corrected by adjusting the hardware components, for example, physically changing the electrical lead connections or manufacturing different leads and lead connectors between actuators. The traditional hardware measures to correct this crossing of the electrical leads add significant cost and complexity to the product.

The disclosed control system and method for resolving crossed electrical leads on a high pressure fuel pump are directed to overcoming one or more of the problems set forth above.

SUMMARY OF THE INVENTION

In one aspect, the present disclosure is directed to a control system for controlling a device. The device includes at least two functional elements, each functional element being controlled by a control signal. The control system may include detecting means operatively connected to the device and configured to monitor the operation of the device, and to generate a signal indicative of an operating condition of the device. The control system may also include a control module operatively connected to the at least two functional elements and the detecting means, and configured to switch the two control signals applied to the respective functional elements in response to the signal generated by the detecting means.

In another aspect, the present disclosure is directed to a method for controlling a device. The device has at least two functional elements, each functional element being controlled by a control signal. The method may include monitoring the operation of the device, generating a signal indicative of the operating condition of the device, and switching the control signals applied to the respective functional elements in response to the signal indicative of the operating condition of the device.

DETAILED DESCRIPTION

A control system for controlling a device, which may include at least two functional elements, each functional element being controlled by a control signal, is disclosed in the present disclosure. The control system may include detecting means operatively connected to the device and configured to monitor the operation of the device, and to generate an error signal when the device is not operating normally. The control system may also include a control module operatively connected to the at least two functional elements and the detecting means, and configured to switch the two control signals applied to the respective functional elements in response to the error signal received from the detecting means.

Figure 1:
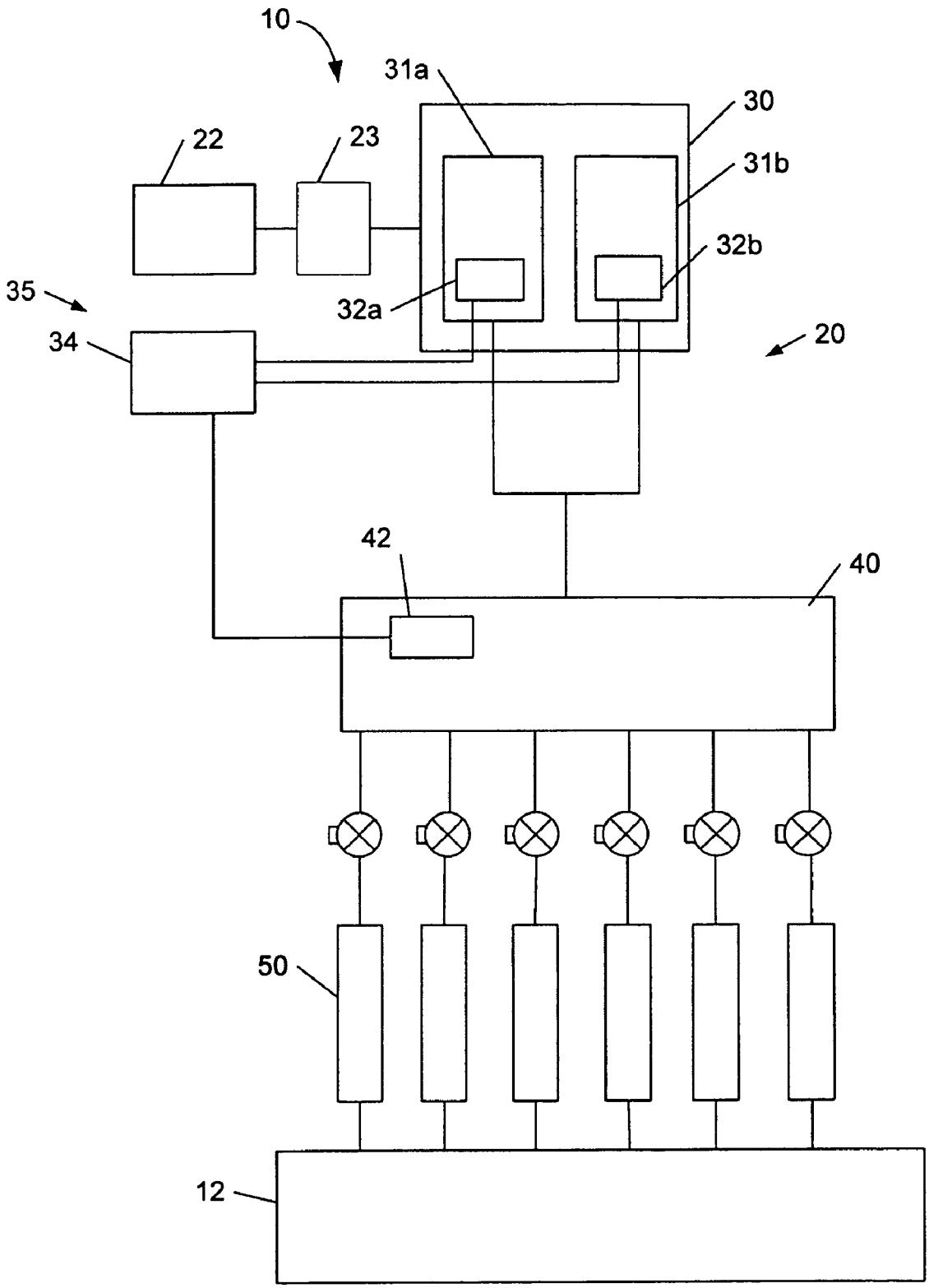
FIG. 1 is a schematic illustration of an exemplary disclosed engine and fuel system.

In one embodiment, the control system may be implemented in an engine fuel system to control the fuel pumps in the fuel system. FIG. 1 shows a schematic representation of an engine system 10 including an engine block 12 and a fuel system 20. Fuel system 20 may include a source of fuel 22, which may be a fuel tank, a feed or priming fuel pump 23, a high pressure fuel pump 30 in fluid communication with the feed pump 23 and fuel tank 22, a common fuel rail 40 in fluid communication with high pressure pump 30, and a plurality of fuel injectors 50 in fluid communication with common rail 40. High pressure fuel pump 30 can be any suitable high pressure high pressure pump, for example, a fixed displacement high pressure pump or a variable displacement high pressure pump. High pressure pump 30 pumps fuel to common rail 40 under high pressure and the common rail 40 provides the highly pressurized fuel to fuel injectors 50. The fuel injectors 50 spray the highly pressurized fuel directly into the combustion chambers of engine block 12, where the fuel is mixed with air and burned. As will be understood, the engine system 10 of the present disclosure may be any type of internal combustion engine, such as a compression ignition or spark ignited internal combustion engine.

High pressure pump 30 may include a plurality of high pressure pumping elements. As shown in FIG. 1, high pressure pump 30 may include two high pressure pumping elements 31*a* and 31*b*. Each high pressure pumping elements 31*a* and 31*b* may reside in a respective pump cylinder to define respective high pressure pumping chambers. Each high pressure pumping chamber may include an inlet valve and an outlet valve. The outlet valve may be a one-way check valve that allows fluid to flow in one direction from the high pressure pumping chamber to common rail 40 when the pressure of the fuel within the pumping chamber is sufficient to open the check valve. The inlet valves of the two high pressure pumping chambers may be respectively controlled by actuators 32*a* and 32*b*. Actuators 32*a* and 32*b* may be, for example, solenoid type actuators. The two high pressure pumping elements 31*a* and 31*b* may be driven by cams carried by a drive shaft that is driven in synchronism with the engine crankshaft.

Details of one of the inlet valves of the high pressure pump 30 will now be discussed, with such details being equally applicable to the other of the inlet valves of the high pressure pump 30. The inlet valve of the high pressure pumping chamber may be normally biased open by a spring to allow fuel to flow from fuel tank 22 and feed pump 23 into the high pressure pumping chamber. Upon actuation of actuator 32*a*, the inlet valve is closed to block the supply of fuel to the pumping chamber. With the inlet valve closed, a specified amount of fuel is trapped within the pumping chamber. This specified amount of fuel in the pumping chamber is then pumped to the high pressure rail 40 during a pumping stroke of the pumping element 31*a*. During the pumping stroke of the pumping element 31*a*, the control signal to actuator 32*a* may terminate and the inlet valve may remain closed by the pressure of the fuel within the pumping chamber. The inlet valve may then reopen under the force of a biasing spring when the pumping element 31*a* begins to retract during a suction stroke and the pressure in the pumping chamber is reduced.

Figure 2:
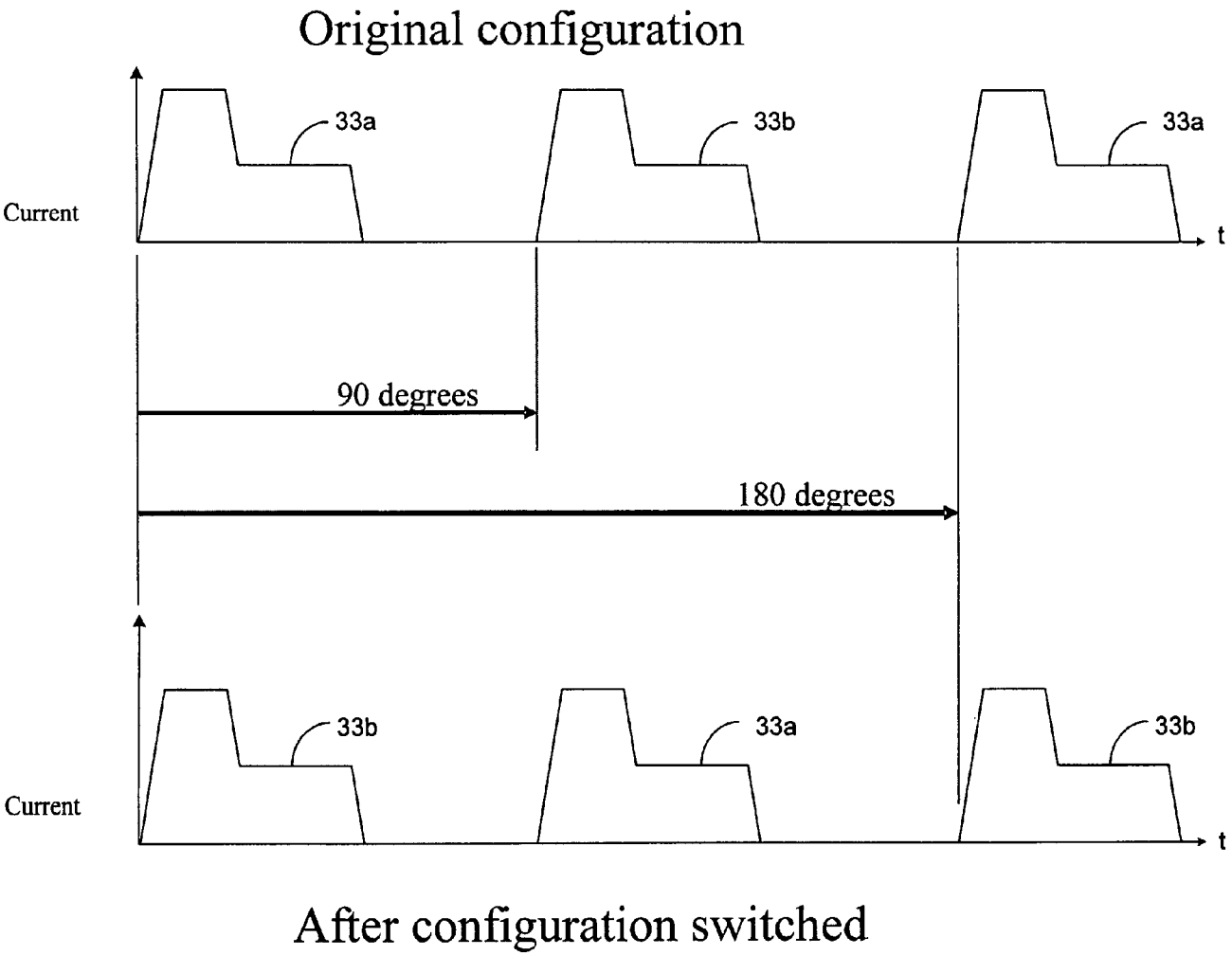
FIG. 2 is a graph of control signals for controlling actuators on a high pressure pump according to one embodiment of the present disclosure, showing the control signals in the original configuration and after the configuration is switched.

Fuel system 20 may further include a control system 35, which may include a control module 34 coupled to high pressure pump 30 and configured to generate two control signals 33*a* and 33*b* to respectively control the two actuators 32*a* and 32*b*. The two control signals 33*a* and 33*b* may be in the form of a periodic waveform as shown in FIG. 2 (waveform 33*a* and waveform 33*b*). Waveforms 33*a* and 33*b* have substantially the same waveform shape and frequency, but have a half-period phase difference. FIG. 2 shows the control signals 33*a* and 33*b* in the original configuration and after the configuration is switched. Each actuator 32*a* and 32*b* may be actuated (causing the inlet valve to close) at the time matching the desired amount of fuel to be delivered in the next pumping stroke. In one embodiment, the waveform sent to the actuators during a desired full pumping quantity may have substantially the same frequency as the frequency of the reciprocal movement of the plunger of the high pressure pumping element, such that each actuator is actuated by the waveform every 180 degrees of the reciprocal movement of the plunger. In another embodiment having more cam lobes driving each of the pumping elements 31*a* and 31*b*, the pumping elements 31*a* and 31*b* may be actuated in sequence, alternating every 90 degrees in a 180 degree cycle, such that the inlet/outlet stroke of high pressure pumping element 31*a* occurs during the outlet/inlet stroke of high pressure pumping element 31*b*. Synchronized with the plungers, the two actuators 32*a* and 32*b* are actuated in sequence with a phase difference of 90 degrees (half of the period).

The control system 35 of fuel system 20 may further include a sensor 42 coupled to common rail 40 for measuring the fuel pressure within common rail 40. Control module 34 is connected to sensor 42 and receives the fuel pressure signal from sensor 42. Control module 34 may be further configured to compare the measured fuel pressure with a predetermined/desired fuel pressure. If the measured fuel pressure is lower than the predetermined pressure, control module may switch which of the two actuators 32*a* and 32*b* receives which of the control signals 33*a* and 33*b*. In other words, if the measured pressure is lower than a desired rail pressure, control module 34 may switch the signals to the actuators 32*a* and 32*b* so that control signal 33*a* is applied to actuator 32*b* and control signal 33*b* is applied to actuator 32*a*. Control module 34 may include a memory, for example, a non-volatile memory, to preserve the relationship between the control signals 33*a* and 33*b* and the actuators 32*a* and 32*b* for subsequent use if the fuel pressure common rail 40 increases beyond a predetermined value after control signals 33*a* and 33*b* are switched (i.e., control signal 33*a* to control actuator 32*b*, and applying control signal 33*b* to control actuator 32*a* in subsequent operations).

INDUSTRIAL APPLICABILITY

The disclosed control to resolve crossed electrical leads of a high pressure fuel pump may be implemented in any high pressure pump that has multiple high pressure pumping elements and electrically actuated pump valves. The disclosed control may also be implemented in any high pressure pump assemblies that have multiple high pressure pumps and electrically actuated pump valves. Further, disclosed control system may be implemented in any system that employs two solenoid actuators that are driven by electrical current having substantially the same waveform shape and a half-period phase difference for resolving crossed-electrical-lead problems. Specifically, the disclosed system may be used to resolve a crossed-electrical-lead condition on solenoid actuators of high pressure pumps, where the electrical leads are used to transmit control signals to the actuators. The operation of the system will now be explained.

Figure 3A:
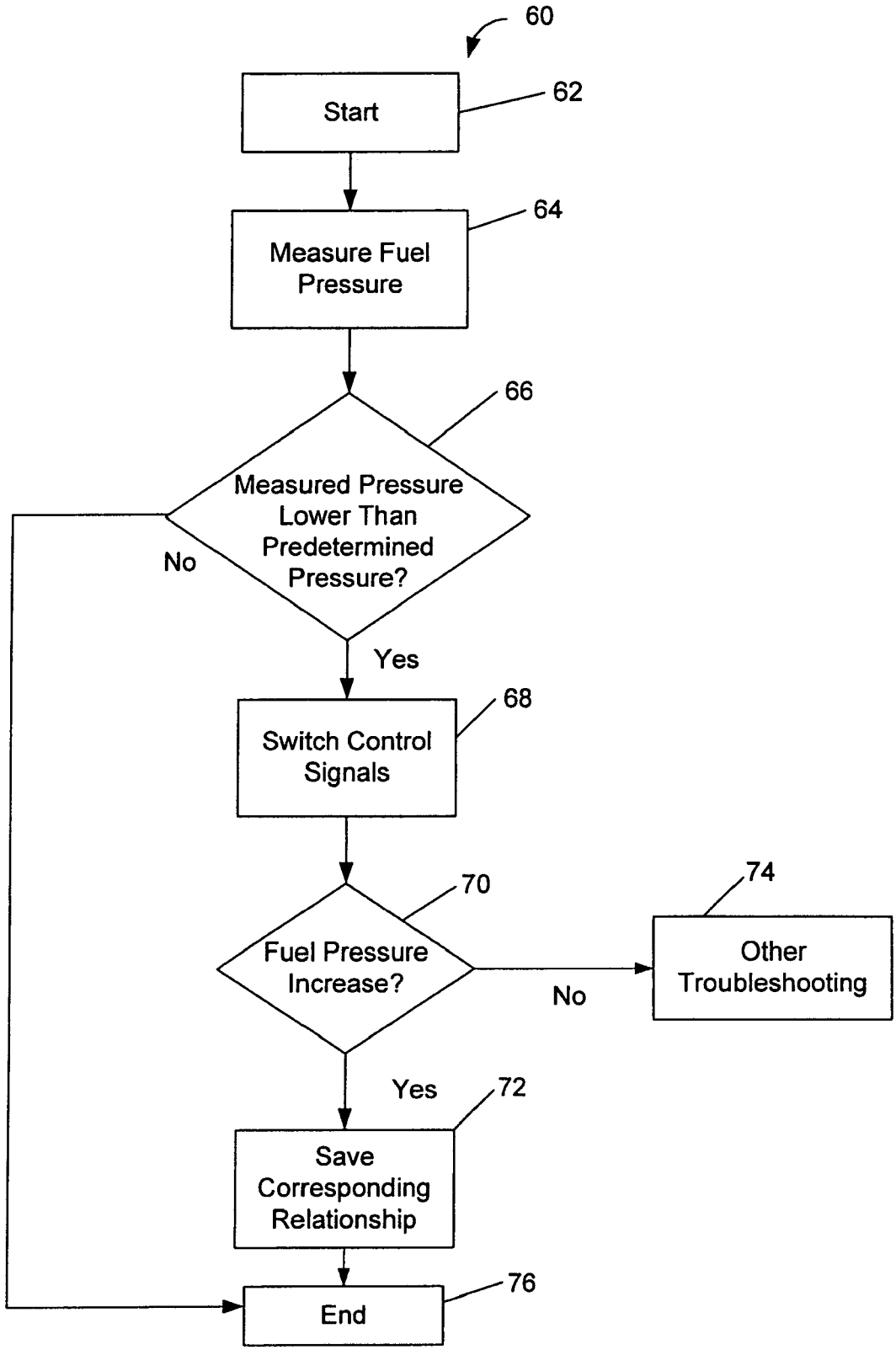
FIG. 3A is a flow chart illustrating an exemplary disclosed method for resolving crossed electrical leads on a high pressure fuel pump.

FIG. 3A illustrates a process 60 for resolving possible crossed electrical leads of a high pressure fuel pump 30 in a fuel system 20. At step 62, engine system 10 is started and control module 34 reads the saved data corresponding to the relationship between the control signals and the actuators, and applies control signals 33*a* and 33*b* to actuators 32*a* and 32*b* based on the saved data. In normal operation, high pressure pumping elements 31*a* and 31*b* pump fuel from the fuel tank 22 and feed pump 23 into common rail 40. If high pressure pump 30 functions properly, the fuel pressure in common rail 40 should start to increase, and should reach a predetermined/desired rail pressure value after a predetermined period of time (e.g., 10 seconds). The fuel pressure in common rail 40 is measured by pressure sensor 42 (step 64). After the predetermined period of time from the start of engine system 10, at step 66, the measured fuel pressure is compared with the predetermined pressure value (e.g., 10 Mpa). If the measured fuel pressure in common rail 40 is equal to or higher than the predetermined fuel pressure, than high pressure pump 30 is considered to be functioning normally with the electrical leads correctly connected to actuators 32*a* and 32*b*. Thus, there is no need for any switching of the control signals 33*a* and 33*b* and the process goes to the end (step 76). If the measured fuel pressure in common rail 40 is lower than the predetermined pressure value, at step 68, control module 34 switches control signals 33*a* and 33*b* so that the control signals 33*a* and 33*b* that have been applied to respective actuators 32*a* and 32*b* are now applied to actuator 32*b* and actuator 32*a*, respectively. At step 70, it is determined whether the fuel pressure increases after the two control signals are switched. If the measured fuel pressure in the common rail 40 increases beyond a predetermined value, the corresponding relationship between the control signals and the actuators (i.e., control signal 33*a* controlling actuator 32*b* and control signal 33*b* controlling actuator 32*a*) is saved in the memory of control module 34 for subsequent operations (step 72), and the process goes to the end (step 76). When the power is turned off and then turned back on again, control module 34 will use the correct phase relationship saved in the memory to drive the actuators 32*a* and 32*b*. If the measured fuel pressure in the common rail 40 is still lower than the predetermined fuel pressure after the control signals are switched, other troubleshooting procedures may be used (step 74).

Figure 3B:
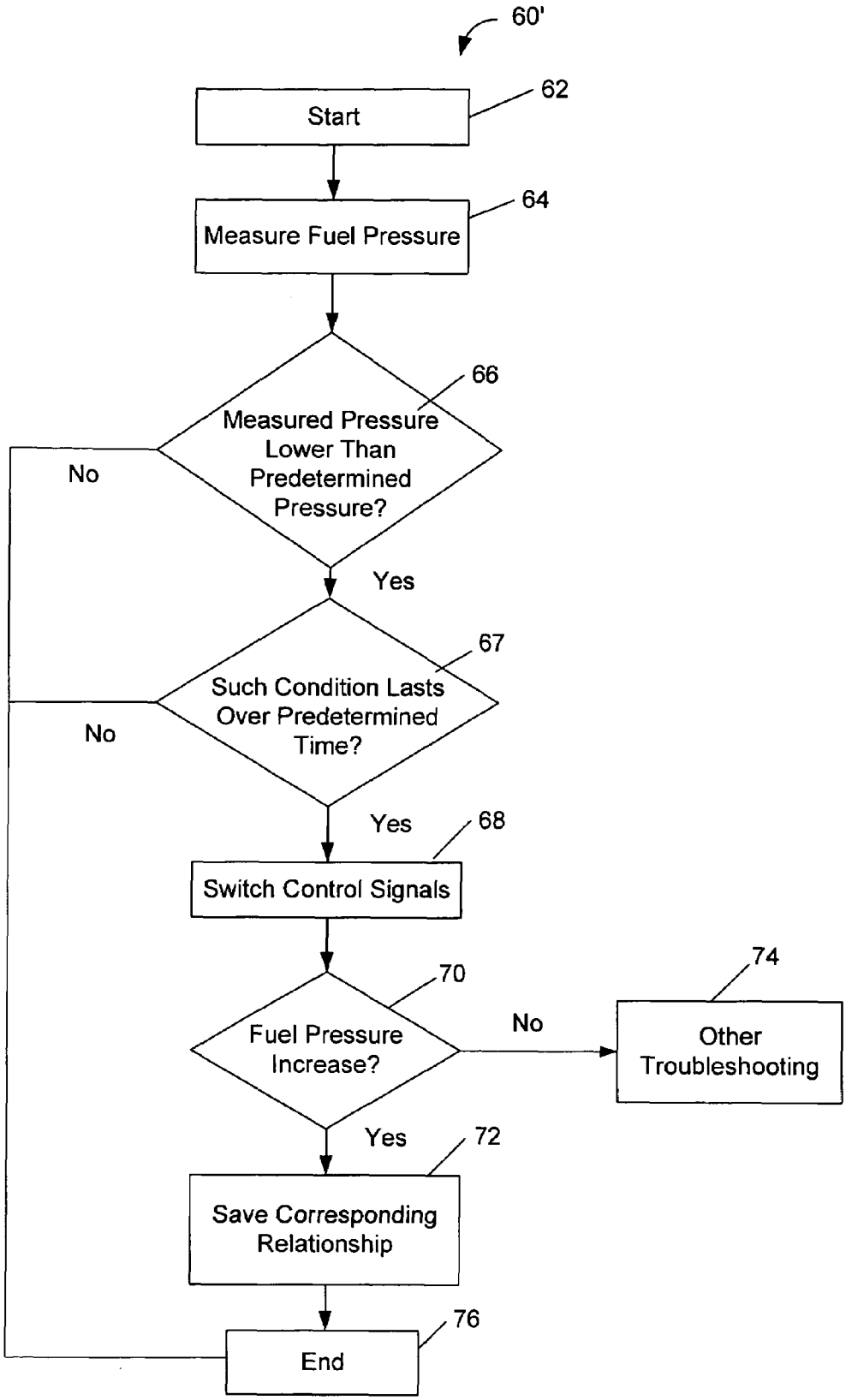
FIG. 3B is a flow chart illustrating another exemplary disclosed method for resolving crossed electrical leads on a high pressure fuel pump.

FIG. 3B illustrates another embodiment of a process in accordance with the present disclosure, which is denoted by reference number 60', for resolving possible crossed electrical leads on a high pressure fuel pump in a fuel system. Process 60' is similar to process 60 shown in FIG. 3A, and elements which are similar or identical to elements in FIG. 3A have the same reference numerals for convenience. The difference between process 60' in FIG. 3B and process 60 in FIG. 3A is that, in process 60', upon determination that the measured fuel pressure is lower than the predetermined/desired fuel pressure (step 66), the fuel pressure in common rail 40 may be continuously measured to determine whether such condition (the fuel pressure being lower than the predetermined pressure) lasts for a predetermined time period, for example, one second (step 67). Control module 34 may be configured to measure the time period. If the condition lasts over the predetermined time period, control module 34 switches the control signals for the actuators 32*a* and 32*b*. If the condition does not last over the predetermined time period and the fuel pressure in common rail 40 becomes greater than the predetermined pressure value, there is no need to switch the control signals for the actuators, and the process goes to the end (step 76).

Several advantages over the prior art may be associated with the disclosed control system and method. The disclosed control system and method uses a software approach to resolve a hardware problem, eliminating the need of any hardware measures for resolving the crossed-electrical-lead condition. With the disclosed control system and method, the crossed-electrical-lead problem for solenoid actuators can be cost-effectively and quickly solved.

It will be apparent to those skilled in the art that various modifications and variations can be made to the disclosed control system and method. Other embodiments will be apparent to those skilled in the art from consideration of the specification and practice of the disclosed control system and method. It is intended that the specification and examples be considered as exemplary only, with a true scope being indicated by the following claims and their equivalents.

What is claimed is:

1. A control system for controlling at least a portion of a hydraulic system, the hydraulic system having at least two functional elements, each functional element being controlled by a control signal, the control system comprising:

detecting means operatively connected to the hydraulic system and configured to monitor the operation of the hydraulic system, wherein the detecting means generates a signal indicative of an operating condition of the hydraulic system; and a control module operatively connected to the at least two functional elements and the detecting means, and configured to switch the two control signals applied to the respective functional elements in response to the signal generated by the detecting means.

2. The control system of claim 1, wherein the signal generated by the detecting means is indicative of an error when the hydraulic system is not operating normally.

3. The control system of claim 1, wherein the control module is further configured to generate the control signals for controlling the at least two functional elements, and wherein the control signals include periodic waveforms having the same frequency, substantially the same shape, and a half-period phase difference.

4. The control system of claim 1, wherein the control module is configured to preserve the corresponding relationship between the control signals and the functional elements if the hydraulic system operates normally after the control signals are switched.

5. A method for controlling at least a portion of a hydraulic system, the hydraulic system having at least two functional elements, each functional element being controlled by a control signal, the method comprising:

monitoring the operation of the hydraulic system;

generating a signal indicative of an operating condition of the hydraulic system; and switching the control signals applied to the respective functional elements in response to the signal indicative of the operating condition of the hydraulic system.

6. The method of claim 5 further including:

preserving the corresponding relationship between the control signals and the functional elements if the signal indicative of the operating condition of the hydraulic system increases beyond a predetermined value after the control signals are switched.

7. A control system for controlling a fuel pump, the fuel pump having at least two pumping chambers, each pumping chamber having at least one of an inlet valve and an outlet valve controlled by an actuator, and the fuel pump being connected to a fuel rail, the control system comprising:

a sensor disposed within the fuel rail and configured to measure the fuel pressure in the fuel rail; and a control module coupled to the pump and configured to generate two control signals to respectively control the two actuators, wherein the control module is further responsive to the measured fuel pressure in the fuel rail and configured to switch the destination of the two control signals applied to the respective actuators if the measured pressure is lower than a predetermined pressure.

8. The control system of claim 7, wherein the control signals include periodic waveforms having a frequency substantially the same as a frequency of two pumping elements located respectively in each of the pumping chambers.

9. The control system of claim 8, wherein the periodic waveforms of the control signals have substantially the same shape and a half-period phase difference.

10. The control system of claim 7, wherein the control signals include periodic waveforms having substantially the same shape and a half-period phase difference.

11. The control system of claim 7, wherein the control module is configured to preserve a corresponding relationship between the control signals and the actuators if the fuel pressure within the fuel rail increases beyond a predetermined value after the control signals are switched.

12. A method for controlling a fuel system, the fuel system including a fuel pump having two pumping chambers, each pumping chamber including at least one of an inlet valve and an outlet valve controlled by an actuator, each actuator being controlled by a respective control signal, and a fuel rail fluidly connected to the pump, the method comprising:

measuring a fuel pressure in the fuel rail;

comparing the measured fuel pressure with a predetermined pressure; and if the measured fuel pressure is lower than the predetermined pressure, switching the control signals applied to the respective actuators.

13. The method of claim 12, wherein measuring the fuel pressure in the fuel rail includes measuring the fuel pressure in the fuel rail after a predetermined time.

14. The method of claim 12 further including:

preserving a corresponding relationship between the control signals and the actuators if the fuel pressure within the fuel rail increases beyond a predetermined value after the control signals are switched.

15. A method for controlling a fuel system, the fuel system including a fuel pump having two pumping chambers, each pumping chamber including at least one of an inlet valve and an outlet valve controlled by an actuator, each actuator being controlled by a respective control signal, and a fuel rail fluidly connected to the pump, the method comprising:

measuring a fuel pressure in the fuel rail;

comparing the measured fuel pressure with a predetermined pressure;

if the measured fuel pressure is lower than the predetermined pressure, measuring the time that the fuel pressure within the fuel rail has been lower than the predetermined pressure;

comparing the time that the fuel pressure within the fuel rail has been lower than the predetermined pressure to a predetermined time period; and if the time that the fuel pressure within the fuel rail has been lower than the predetermined pressure is greater than the predetermined time period, switching the control signals applied to the respective actuators.

16. The method of claim 15, wherein measuring the fuel pressure within the fuel rail includes measuring the fuel pressure in the fuel rail after a predetermined time.

17. The method of claim 15 further including:

preserving a corresponding relationship between the control signals and the actuators if the fuel pressure within the fuel rail increases beyond a predetermined value after the control signals are switched.

18. A fuel system comprising:

a fuel pump having at least two pumping chambers, wherein each pumping chamber includes at least one of an inlet valve and an outlet valve controlled by an actuator;

a fuel rail fluidly connected to the two pumping chambers;

a sensor coupled to the fuel rail and configured to measure the fuel pressure in the fuel rail;

a control module coupled to the pump and configured to generate two control signals to respectively control the two actuators, wherein the control module is further responsive to the measured fuel pressure in the fuel rail and configured to switch the two control signals applied to the respective actuators if the measured pressure is lower than a predetermined pressure.

19. The fuel injection system of claim 18, wherein the actuators are solenoid actuators.

20. The fuel injection system of claim 18, wherein the control signals include periodic waveforms having substantially the same frequency as a frequency of two pumping elements located respectively in each of the pumping chambers.

21. The fuel injection system of claim 20, wherein the periodic waveforms of the control signals have substantially the same shape and a half-period phase difference.

22. The fuel injection system of claim 18, wherein the control signals include periodic waveforms having substantially the same frequency, same waveform shape, and a half-period phase difference.

23. The fuel injection system of claim 18, wherein the control module is configured to preserve a corresponding relationship between the control signals and the actuators if the fuel pressure within the fuel rail increases beyond a predetermined value after the control signals are switched.

* * * * *